US011433448B2

(12) United States Patent
Peng et al.

(10) Patent No.: US 11,433,448 B2
(45) Date of Patent: Sep. 6, 2022

(54) HIGH-FREQUENCY CONTINUOUS ELECTROMAGNETIC FORMING DEVICE FOR PLATE FORMATION

(71) Applicant: SHANGHAI JIAO TONG UNIVERSITY, Shanghai (CN)

(72) Inventors: Linfa Peng, Shanghai (CN); Xianan Li, Shanghai (CN); Tianhao Jiang, Shanghai (CN); Peiyun Yi, Shanghai (CN); Xinmin Lai, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 0 days.

(21) Appl. No.: 16/966,955

(22) PCT Filed: Jan. 3, 2019

(86) PCT No.: PCT/CN2019/070162
§ 371 (c)(1),
(2) Date: Aug. 3, 2020

(87) PCT Pub. No.: WO2019/169944
PCT Pub. Date: Sep. 12, 2019

(65) Prior Publication Data

US 2021/0046536 A1 Feb. 18, 2021

(30) Foreign Application Priority Data

Mar. 8, 2018 (CN) ..... 201810191594.7

(51) Int. Cl.
*B21D 26/14* (2006.01)

(52) U.S. Cl.
CPC ..... *B21D 26/14* (2013.01)

(58) Field of Classification Search
CPC .... B21D 26/14; B21D 43/08; B29C 35/0805; B30B 11/008
See application file for complete search history.

(56) References Cited

U.S. PATENT DOCUMENTS

2010/0175446 A1* 7/2010 Jones ..... H01F 41/077 72/54
2012/0006085 A1* 1/2012 Johnson ..... C22C 1/002 72/54

(Continued)

FOREIGN PATENT DOCUMENTS

CN 2887479 Y 4/2007
CN 101590501 A 12/2009

(Continued)

OTHER PUBLICATIONS

International Search Report (in English and Chinese) and Written Opinion published in PCT/CN2019/070162, dated Mar. 25, 2019, 11 pages provided.

*Primary Examiner* — Jessica Cahill
*Assistant Examiner* — Bobby Yeonjin Kim
(74) *Attorney, Agent, or Firm* — Hamre, Schumann, Mueller & Larson, P.C.

(57) ABSTRACT

A high-frequency continuous electromagnetic forming device for plate formation comprises a charger, a control terminal, a continuous charge-discharge device, a forming coil and a plate access terminal. The charger is used for charging the continuous charge-discharge device. Capacitor banks are arranged in the continuous charge-discharge device, and capacitors in the capacitor banks are sequentially discharged through an electromagnetic coil to apply a pulsed electromagnetic force to a workpiece to complete one forming process, and after discharging, the capacitors are charged to prepare for further discharging, so that continuous formation is realized. The control terminal is connected to the continuous charge-discharge device and the plate access terminal, and the forming coil is connected to the continuous charge-discharge device through a wire.

19 Claims, 2 Drawing Sheets

(56) References Cited

U.S. PATENT DOCUMENTS

| | | | | |
|---|---|---|---|---|
| 2017/0050230 | A1* | 2/2017 | Lee | B21D 51/2607 |
| 2017/0095855 | A1* | 4/2017 | Niaraki | B30B 1/42 |

FOREIGN PATENT DOCUMENTS

| | | | |
|---|---|---|---|
| CN | 102259132 | A | 11/2011 |
| CN | 103464564 | A | 12/2013 |
| CN | 103861932 | A | 6/2014 |
| CN | 105203412 | A | 12/2015 |
| CN | 206824460 | U | 1/2018 |
| CN | 108380724 | A | 8/2018 |
| JP | 2007296553 | A | 11/2007 |

* cited by examiner

HIGH-FREQUENCY CONTINUOUS ELECTROMAGNETIC FORMING DEVICE FOR PLATE FORMATION

BACKGROUND OF THE INVENTION

1. Technical Field

The invention relates to the field of electromagnetic formation, in particular to a high-frequency continuous electromagnetic forming device for plate formation.

2. Description of Related Art

Originating at the end of 1950s, the electromagnetic forming technology rapidly developed in 1960s and 1970s and was applied more and more rapidly and studied more and more intensively at the end of the $20^{th}$ century and the beginning of the 21th century. This technology is primarily used for the compression of metal parts, the extension of formation and the formation of plates. The basic theory of the electromagnetic forming technology lies in that induction currents are produced in a part by dint of a magnetic field generated by currents across a discharge coil, and create a pulsed magnetic field force under the influence of the magnetic field of the coil to realize plastic deformation of the formed part in a short time.

This forming technology mainly has the following features: first, the formed part does not make contact with the coil when machined, so that the machining process is environmentally friendly; second, the one-shot forming efficiency is high, the forming time is short and is generally 1-2 ms, and the production process is affected by loading and unloading; and third, the forming speed and strain rate of the formed part in the forming process are high, so that the performance of materials can be improved to a certain extent, and rebounds and wrinkles are reduced, and the precision of the formed part is improved. Therefore, this technology has been widely applied in the fields of expanding formation of tube blanks, formation of complex flat plates, shaping of thin plates, and the like.

Plate formation, as an important formation method, is widely applied in the fields of automobile production, bipolar plate production and the like, and higher and higher requirements for the precision and performance of plate formation have been put forward with the development of industry. Traditional plate formation methods such as punching formation and hydraulic expanding formation fail to solve the problems of rebounds, stress concentration and material thinning in the forming process. The emergence of the electromagnetic forming technology explores a new idea for solving these problems.

Although the electromagnetic forming technology can solve some problems of traditional plate formation, it still has certain problems that have not been solved yet due to its technical features.

First of all, the limitation of the forming power results in a small forming area which is mostly within 100 $cm^2$, so that large-area plates cannot be formed at a time, thus leading to a decrease of the overall forming efficiency; and moreover, one device can only form parts in one shape, and molds have to be changed to form parts in complicated shapes, so that operation is complex, and the forming efficiency is low. Chinese Utility Model Patent Application No. 200620095508.5 discloses an electromagnetic incremental forming device which consists of a computer control system, an electromagnetic force generation system, a plate clamping and lifting device, a mold support, an electromagnetic-formation clamp rod, and the like, wherein a forming coil is controlled by a computer to move to realize local incremental formation, so that large plates in different shapes can be formed.

However, this device has the following drawbacks: charging and discharging have to be performed every time a plate is formed, and the overall machining speed is decreased by the charging process; and meanwhile, the absence of mold limitations in the forming process results in poor forming precision. Chinese Invention Patent Application No. 201310397820.4 discloses an electromagnetic forming device for aluminum alloy rib plates, which comprises two web coils used for forming rib plates, a forming mold, a coil guide rail, and the like. The working efficiency is improved through the cooperation of two forming coils. However, this device has following drawbacks: this device is merely applicable to special formed parts and is not universal, and the two forming coils still fail to solve the problem of low forming efficiency caused by the charging process.

BRIEF SUMMARY OF THE INVENTION

The objective of the invention is to overcome the drawbacks of the prior art by providing an electromagnetic plate forming device which is reasonable in structure, high in production efficiency and wide in application range to meet equipment requirements of production of electromagnetically-formed plates.

The technical concept adopted by the invention to fulfill the above objective primarily includes the following two aspects:

First, continuous charging and discharging of capacitor banks are realized through the rotation of a continuous charge-discharge device; when one capacitor bank discharges to a forming coil through a wire, the other capacitor banks are charged by a charger, so that the time to charge the capacitor banks is eliminated in the continuous forming process, and the forming efficiency is improved;

Second, plates are automatically transported from a plate access terminal through plate transport wheels, and mold switching and demolding are completed through a mold installation frame to satisfy multi-step machining requirements, and the whole forming process is controlled by a control terminal.

The objective of the invention is fulfilled through the following technical solution:

A high-frequency continuous electromagnetic forming device for plate formation comprises a charger, a control terminal, a continuous charge-discharge device, a forming coil, and a plate access terminal, wherein:

The charger is used for charging the continuous charge-discharge device;

Capacitor banks are arranged in the continuous charge-discharge device, capacitors in the capacitor banks are sequentially discharged through an electromagnetic coil to apply a pulsed electromagnetic force to a workpiece to complete one forming process, and after discharging, the capacitors are charged to prepare for further discharging, so that continuous formation is realized;

The control terminal is connected to the continuous charge-discharge device and the plate access terminal; and The forming coil is connected to the continuous charge-discharge device through a wire.

Continuous charging and discharging of the capacitor banks are realized through the rotation of the continuous charge-discharge device; and when one capacitor bank discharges to the forming coil through the wire, the other capacitor banks are charged by the charger, so that the time to change the capacitor banks is eliminated in the continuous forming process, and the forming efficiency is improved.

Plates are automatically transported from the plate access terminal through plate transport wheels, mold switching and demolding are realized through a mold installation frame to satisfy multi-step machining requirements, and the whole forming process is controlled by the control terminal.

As a preferred implementation, the charger comprises a voltage source and a charge electrode, an output voltage meets one-shot forming requirements, the tail end of the charge electrode is connected to an arc duct, and the duct has an arc center aligned to the rotating axes of the capacitor banks and is matched with capacitor bank charge terminals.

As a preferred implementation, the continuous charge-discharge device is of a cylindrical structure, has a constant axis, and is able to rotate around the axis, and identical cylindrical chambers are formed at equal intervals in the circumferential direction of the continuous charge-discharge device.

As a preferred implementation, the capacitor banks are of a cylindrical structure, are fixed in the chambers of the continuous charge-discharge device, and rotate along with the continuous charge-discharge device, and positive poles and negative poles stretch out of the front sides and the back sides of the capacitor banks.

As a preferred implementation, the wire is fixed by a fixing device and has an end connected to a discharge coil in the forming coil and an end connected to the arc duct at the tail end of the charge electrode.

As a preferred implementation, the arc duct has the center aligned to the rotating axes of the capacitor banks and is matched with capacitor bank discharge terminals, and only one capacitor bank is allowed to discharge through the arc duct at each moment.

As a preferred implementation, the forming coil is located over a plate, has a plane parallel to the plate and exactly faces a plate forming area, and a fixing and protecting device is arranged above the forming coil to protect the coil from being damaged by a reactive force in the forming process.

As a preferred implementation, the plate access terminal comprises plate transport wheels and a mold installation frame, wherein each plate transport wheel consists of two cylindrical rollers arranged at the two ends of the plate and used for clamping the plate, and the plate is transported forwards along with the rotation of the rollers; the mold installation frame comprises a plurality of mold racks which are able to rotate around a spindle; in the forming process, the mold racks are switched to ensure that there is always one mold rack below the plate; and forming molds are fixed to the mold installation frame, are able to move along with the mold installation frame, and move downwards along with the mold racks, every time formation is completed, to strip the plate.

As a more preferred implementation, the mold racks rotate upwards vertically or horizontally around the spindle.

As a preferred implementation, the control terminal controls the rotation of the continuous charge-discharge device, the rotation of the plate transport wheels and the movement of the mold installation frame to make that the continuous charge-discharge device, the plate transport wheels and the mold installation frame effectively cooperate with one another in the forming process.

Compared with the prior art, the invention has the following beneficial effects: the capacitor banks are installed on the continuous charge-discharge device to be continuously charged and discharged; every time one capacitor bank discharges, one workpiece is formed; and particularly, during discharging, currents reach the forming coil through the wire to generate a vortex magnetic field and apply an instant lorentz force to the workpiece, and then the workpiece is formed under the restraint of a mold. After discharging, the capacitors are automatically charged. The forming molds can be changed at a mold access terminal to realize complicated formation requiring various molds. The control terminal regulates and matches the switching rate of the continuous charge-discharge device, demolding and raw material conveying to make sure that the whole device can operate stably. The high-frequency continuous electromagnetic forming device is reasonable in structure, solves the problem that large plates cannot be electromagnetically formed at a time, improves the production efficiency by about two times, and is easy to adjust, low in cost, and suitable for plate formation.

Reference signs: 1, voltage source; 2, charge electrode; 3, charge terminal guide rail; 4, capacitor bank charge terminal; 5, rotary cavity; 6, capacitor bank; 7, capacitor bank discharge terminal; 8, discharge terminal guide rail; 9, wire; 10, wire holder; 11, controller; 12, coil protection plate; 13, plate; 14, discharge coil; 15, plate guide wheel; 16, control circuit; 17, mold installation frame; 18, frame spindle; 19, mold assembly; 20, spindle guide rail; 21, frame base.

DETAILED DESCRIPTION OF THE INVENTION

The invention is expounded below in combination with specific embodiments. The following embodiments are provided to assist those skilled in the art in further appreciation of the invention, and are not intended to limit the invention in any forms. It should be noted that those ordinarily skilled in the art can make various transformations and improvements without deviating from the concept of the invention, and all these transformations and improvements should also fall within the protection scope of the invention.

Embodiment 1

Figure 1:
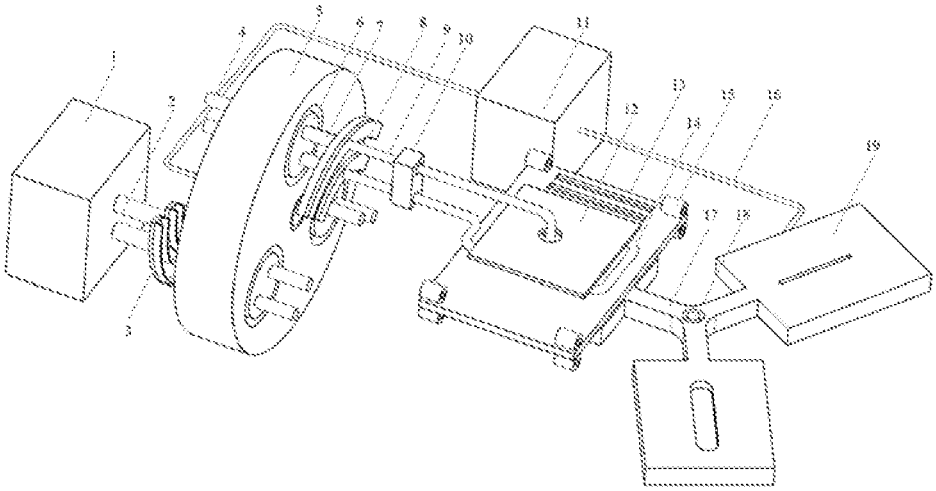
FIG. 1 is a perspective view of the invention.
Figure 2:
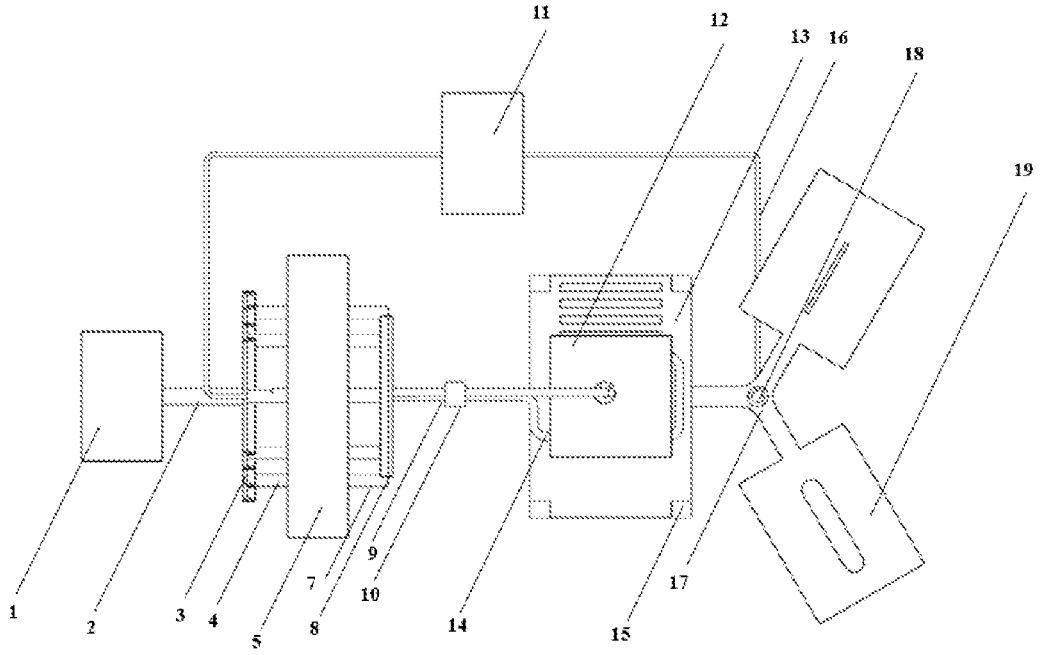
FIG. 2 is a top view of the invention.
Figure 3:
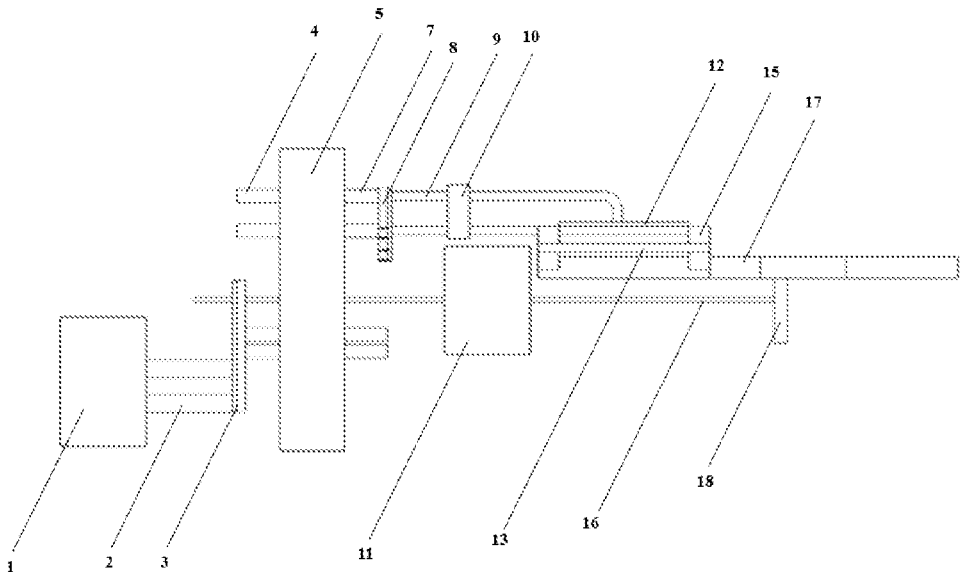
FIG. 3 is a front view of the invention.

A high-frequency continuous electromagnetic forming device for plate formation comprises a charger, a control terminal, a continuous charge-discharge device, capacitor banks, a forming coil, a plate access terminal, and the like, as shown in FIG. 1-FIG. 3. Wherein, the charger, the continuous charge-discharge device and the capacitor banks consist of a voltage source 1, a charge electrode 2, a charge terminal guide rail 3, capacitor bank charge terminals 4, a rotary cavity 5, capacitor banks 6, capacitor bank discharge terminals 7, a discharge terminal guide rail 8, a wire 9, and a wire holder 10. In an embodiment, the charger includes the voltage source 1 and the charge electrode 2; the continuous charge-discharge device includes the charge terminal guide rail 3, the rotary cavity 5, the discharge terminal guide rail 8, the wire 9, and the wire holder 10; and the capacitor banks include the capacitor bank charge terminals 4, the capacitor banks 6, and capacitor bank discharge terminals 7. The capacitor banks 6 are arranged in chambers of the rotary cavity 5 and rotate along with the rotary cavity 5 to complete a charge-discharge cycle, and the number of the chambers of the rotary cavity 5, the capacitance of each capacitor bank, and the charge voltage depend on the actual production condition. An angle of circumference corresponding to the charge terminal guide rail 3 and an angle of circumference corresponding to the discharge terminal guide rail 8 are determined as actually needed, and a gap should be reserved between the angles of circumference corresponding to the charge terminal guide rail 3 and the discharge terminal guide rail 8 to guarantee smooth switching of the capacitor banks 6 between charging and discharging. The angle of circumference of the discharge terminal guide rail 8 should be smaller than an angle of circumference between every two adjacent capacitor banks to make sure that only one capacitor bank discharges at every moment.

The forming coil and the plate access terminal consist of a coil protection plate 12, a discharge coil 14, plate guide wheels 15, a mold installation frame 17, a frame spindle 18 and mold assemblies 19. In an embodiment, the forming coil includes the coil protection plate 12 and the discharge coil 14; and the plate access terminal includes the plate guide wheels 15, the mold installation frame 17, the frame spindle 18, and the mold assemblies 19. The discharge coil 14 is located over a plate forming part, does not make contact with a plate 13 and is protected by the coil protection plate 12 above against damage caused by a reactive force in the forming process. The mold assemblies 19 are arranged on the mold installation frame 17, and the type and quantity of molds needed for formation depend on the specific production condition. The mold installation frame 17 is able to rotate around the frame spindle 18 to ensure that a mold needed for present formation can rotate to a position under the plate 13 forming part, and the mold installation frame 17 is able to entirely move downwards to ensure that the plate 13 can be stripped from the mold after being formed.

The control terminal consists of a controller 11 and a control circuit 16. The controller 11 is connected to the continuous charge-discharge device and the plate access terminal through the control circuit 16 and controls the movement of the rotary cavity 5, the plate guide wheels 15, the mold installation frame 17 and the frame spindle 18 to make sure that the rotary cavity 5, the plate guide wheels 15, the mold installation frame 17 and the frame spindle 18 cooperate with one another to complete the forming process. The specific movement speed and movement manner depend on actual production requirements.

The working process of high-frequency continuous electromagnetic plate forming of the invention is briefly described as follows: the control terminal 11 controls the rotary cavity 5 to rotate, the plate 13 and the mold assembly 19 on the right are kept static when the previous capacitor bank leaves the capacitor bank discharge terminal 7 and the next capacitor bank has not yet reached the capacitor bank discharge terminal 7, and the plate forming part, the forming mold and the discharge coil 14 are located at corresponding positions. The rotary cavity 5 continues to rotate, the capacitor bank discharge terminal 7 of the capacitor bank 6 makes contact with the discharge terminal guide rail 8 to start to discharge through the wire 9 and the discharge coil 14 to generate a pulsed electromagnetic force to form the plate 13, the forming process will not stop until the capacitor bank discharge terminal 7 leaves the discharge terminal guide rail 8, and in this way, one forming process is ended. When the next capacitor bank enters the gap in front of the discharge terminal guide rail 8, the control terminal 11 controls the mold installation frame 17 to move downwards to realizing demolding, the plate guide wheels 15 drive the plate 13 to move to the next forming position, the mold installation frame 17 rotates a required mold to the position under the plate, then the next capacitor bank enters the discharge terminal guide rail 8 to start the next forming process, the previous capacitor bank charge terminal 4 enters the charge terminal guide rail 3 to be charged by the voltage source, and in this way, one complete process cycle is completed. This process cycle is repeated constantly in the whole production process.

Embodiment 2

Figure 4:
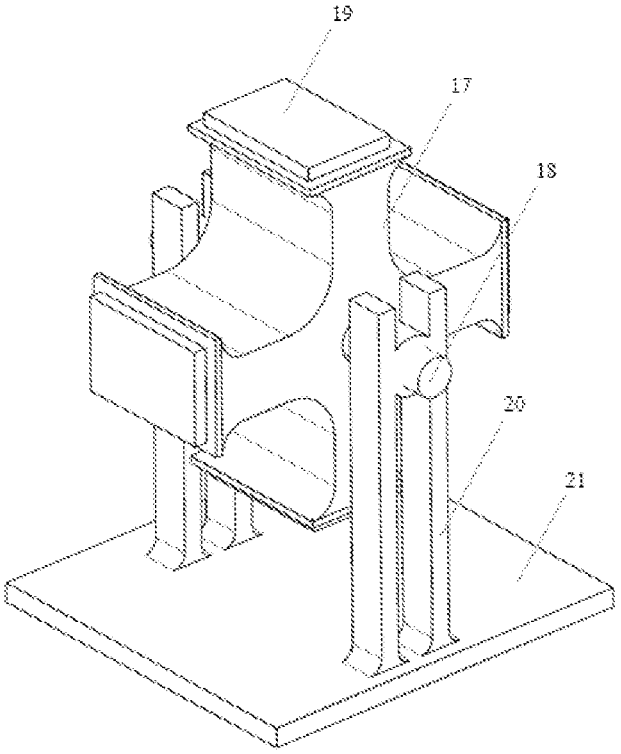
FIG. 4 is a structural view of a plate access terminal in Embodiment 2.

As shown in FIG. 4, the plate access terminal of the high-frequency continuous electromagnetic forming device for plate formation consists of mold assemblies 19, a mold installation frame 17, a frame spindle 18, spindle guide rails 20, and a frame base 21. In this embodiment, mold racks vertically rotate around the spindle. Particularly, molds in the mold assemblies 19 are fixed to the end face of the mold installation frame 17, and the mold installation frame 17 can be controlled by the control terminal to rotate around the frame spindle 18 and can move upwards or downwards along the spindle guide rails 20 together with the frame spindle 18 during demolding. The spindle guide rails 20 are fixedly connected to the frame base 21 below, so that the stability in the operating process is guaranteed.

The working process of high-frequency continuous electromagnetic plate formation of the invention is brief described as follows: the capacitor bank is switched; after the previous capacitor bank leaves the discharge terminal guide rail 8 and the next capacitor bank has not yet entered the discharge terminal guide rail 8, the control terminal 11 controls the mold installation frame 17 to move downwards along the spindle guide rails 20 to realize demolding, and the plate guide wheels 15 drive the plate 13 to move to the next forming position; and the mold installation frame 17 rotates around the frame spindle 18 until the required mold reaches the position under the plate, and then moves upwards along the spindle guide rails 20 to the required forming position to start the next forming process. This process is repeated constantly. This embodiment is identical in other processes and other structural components with Embodiment 1.

The specific embodiments of the invention are described above. It should be noted that the invention is not limited to the above specific embodiments, and those skilled in the art can make various transformations or modifications within the scope of the claims without affecting the essential contents of the invention.

What is claimed is:

1. A high-frequency continuous electromagnetic forming device for plate formation, comprising a charger, a control terminal, a continuous charge-discharge device, a forming coil and a plate access terminal, wherein:

the charger is configured to charge the continuous charge-discharge device;

capacitor banks are arranged in the continuous charge-discharge device, capacitors in the capacitor banks are configured to be sequentially discharged through an electromagnetic coil to apply a pulsed electromagnetic force to a workpiece to complete one forming process, and after discharging, the capacitors are configured to be charged to prepare for further discharging, so that continuous formation is realized;

the control terminal is connected to the continuous charge-discharge device and the plate access terminal; and the forming coil is connected to the continuous charge-discharge device through a wire.

2. The high-frequency continuous electromagnetic forming device for plate formation according to claim 1, wherein the charger comprises a voltage source and a charge electrode, an output voltage meets one-shot formation requirements, a tail end of the charge electrode is connected to an arc duct, and the arc duct has an arc center aligned to rotating axes of the capacitor banks and is matched with capacitor bank charge terminals, an arc of the art duct follows a rotational path of the capacitor bank charge terminals.

3. The high-frequency continuous electromagnetic forming device for plate formation according to claim 2, wherein the wire is fixed by a fixing device and has an end connected to a discharge coil in the forming coil and an end connected to the arc duct at the tail end of the charge electrode.

4. The high-frequency continuous electromagnetic forming device for plate formation according to claim 2, wherein the arc duct has the center aligned to the rotating axes of the capacitor banks and is matched with capacitor bank discharge terminals, and only one said capacitor bank is allowed to discharge through the arc duct at every moment.

5. The high-frequency continuous electromagnetic forming device for plate formation according to claim 1, wherein the continuous charge-discharge device is of a cylindrical structure, has a constant axis and is able to rotate around the axis, and identical cylindrical chambers are formed at equal intervals in a circumferential direction of the continuous charge-discharge device.

6. The high-frequency continuous electromagnetic forming device for plate formation according to claim 5, wherein the capacitor banks are of a cylindrical structure, are fixed in the chambers of the continuous charge-discharge device, and rotate along with the continuous charge-discharge device, and positive poles and negative poles stretch out of front sides and back sides of the capacitor banks.

7. The high-frequency continuous electromagnetic forming device for plate formation according to claim 1, wherein the forming coil is located over a plate, has a plane parallel to the plate, and exactly faces a plate forming area, and a fixing and protecting device is arranged above the forming coil to protect the forming coil from being damaged by a reactive force in the forming process.

8. The high-frequency continuous electromagnetic forming device for plate formation according to claim 1, wherein the plate access terminal comprises plate transport wheels and a mold installation frame, each said plate transport wheel consists of two cylindrical rollers disposed at two ends of the plate and configured for clamping the plate, and the place is configured to be transported forwards with the rotation of the rollers; and the mold installation frame comprises a plurality of mold racks capable of rotating around a spindle, and the mold racks are switched in the forming process to ensured that there is always one said mold rack below the plate, and forming molds are fixed to the mold installation frame, are able to move along with the mold installation frame, and configured to move downwards along with the mold racks, every time formation is completed, to strip the plate.

9. The high-frequency continuous electromagnetic forming device for plate formation according to claim 8, wherein the mold racks are configured to rotate upwards horizontally or vertically along the spindle.

10. The high-frequency continuous electromagnetic forming device for plate formation according to claim 8, wherein the control terminal controls the rotation of the continuous charge-discharge device, the rotation of the plate transport wheels and the movement of the mold installation frame to ensure that the continuous charge-discharge device, the plate transport wheels and the mold installation frame effectively cooperate with one another in the forming process.

11. The high-frequency continuous electromagnetic forming device for plate formation according to claim 1, wherein continuous charging and discharging of the capacitor banks are realized through a rotation of the continuous charge-discharge device, when one capacitor bank discharges to the forming coil through the wire, other capacitor banks are charged by the charger.

12. A high-frequency continuous electromagnetic forming device for plate formation, comprising a charger, a control terminal, a continuous charge-discharge device, a forming coil and a plate access terminal, wherein:

the charger is configured to charge the continuous charge-discharge device;

capacitor banks are arranged in the continuous charge-discharge device, capacitors in the capacitor banks are configured to be sequentially discharged through an electromagnetic coil to apply a pulsed electromagnetic force to a workpiece to complete one forming process, and after discharging, the capacitors are configured to be charged to prepare for further discharging, so that continuous formation is realized;

the control terminal is connected to the continuous charge-discharge device and the plate access terminal;

the forming coil is connected to the continuous charge-discharge device through a wire;

the charger incudes a voltage source and a charge electrode, an output voltage meets one-shot formation requirements, a tail end of the charge electrode is connected to an arc duct, and the arc duct has an arc center aligned to rotating axes of the capacitor banks and is matched with capacitor bank charge terminals; an arc of the art duct follows a rotational path of the capacitor bank charge terminals;

the continuous charge-discharge device is of a cylindrical structure, has a constant axis and is able to rotate around the axis, and identical cylindrical chambers are formed at equal intervals in a circumferential direction of the continuous charge-discharge device, each of the capacitor banks is spaced away from each other at equal intervals and is disposed in each of the corresponding cylindrical chambers along the circumferential direction of the cylindrical structure, each of the capacitor banks has at least one charge terminal and at least one discharge terminal, when one capacitor bank of the capacitor banks discharges to the forming coil through the wire, the at least one discharge terminal of the one capacitor bank connects to the wire through an arc-shaped discharge terminal guide rail, and the at least one charge terminal of another capacitor bank of the capacitor banks connects to the charge electrode through the arc duct and is charged by the charger.

13. The high-frequency continuous electromagnetic forming device for plate formation according to claim 12, wherein the capacitor banks are of a cylindrical structure, are fixed in the chambers of the continuous charge-discharge device, and are configured to rotate along with the continuous charge-discharge device, and positive poles and negative poles stretch out of front sides and back sides of the capacitor banks.

14. The high-frequency continuous electromagnetic forming device for plate formation according to claim 12, wherein the wire is fixed by a fixing device and has an end connected to a discharge coil in the forming coil and an end connected to the arc duct at the tail end of the charge electrode.

15. The high-frequency continuous electromagnetic forming device for plate formation according to claim 12, wherein the arc duct has the center aligned to the rotating axes of the capacitor banks and is matched with capacitor bank discharge terminals, and only one said capacitor bank is allowed to discharge through the arc duct at every moment.

16. The high-frequency continuous electromagnetic forming device for plate formation according to claim 12, wherein the forming coil is located over a plate, has a plane parallel to the plate, and exactly faces a plate forming area, and a fixing and protecting device is arranged above the forming coil to protect the forming coil from being damaged by a reactive force in the forming process.

17. The high-frequency continuous electromagnetic forming device for plate formation according to claim 12, wherein the plate access terminal comprises plate transport wheels and a mold installation frame, each said plate transport wheel consists of two cylindrical rollers disposed at two ends of the plate and configured to clamp the plate, and the plate is transported forwards with the rotation of the rollers; and the mold installation frame comprises a plurality of mold racks capable of rotating around a spindle, and the mold racks are configured to be switched in the forming process to ensured that there is always one said mold rack below the plate, and forming molds are fixed to the mold installation frame, are able to move along with the mold installation frame, and move downwards along with the mold racks, every time formation is completed, to strip the plate.

18. The high-frequency continuous electromagnetic forming device for plate formation according to claim 17, wherein the mold racks are configured to rotate upwards horizontally or vertically along the spindle.

19. The high-frequency continuous electromagnetic forming device for plate formation according to claim 17, wherein the control terminal is configured to control the rotation of the continuous charge-discharge device, the rotation of the plate transport wheels and the movement of the mold installation frame to ensure that the continuous charge-discharge device, the plate transport wheels and the mold installation frame effectively cooperate with one another in the forming process.

* * * * *